US008271127B2

(12) United States Patent
Cartal et al.

(10) Patent No.: US 8,271,127 B2
(45) Date of Patent: Sep. 18, 2012

(54) METHOD OF SORTING MAILPIECES IN A LOW-CAPACITY MACHINE

(75) Inventors: Bruno Cartal, Montelier (FR); Nicolas Basset, Saint Paul Trois Chateaux (FR); Didier Tresse, Saint Laurent d'Onay (FR)

(73) Assignee: Solystic, Gentilly Cedex (FR)

( * ) Notice: Subject to any disclaimer, the term of this patent is extended or adjusted under 35 U.S.C. 154(b) by 80 days.

(21) Appl. No.: 12/812,317

(22) PCT Filed: May 4, 2010

(86) PCT No.: PCT/FR2010/050853

§ 371 (c)(1),
(2), (4) Date: Jul. 9, 2010

(87) PCT Pub. No.: WO2010/130920

PCT Pub. Date: Nov. 18, 2010

(65) Prior Publication Data

US 2011/0066280 A1 Mar. 17, 2011

(30) Foreign Application Priority Data

May 15, 2009 (FR) ..... 09 53252

(51) Int. Cl.
*B07C 3/00* (2006.01)

(52) U.S. Cl. ..... 700/223; 700/224; 209/584

(58) Field of Classification Search ..... 700/219, 700/223, 224; 705/317–319, 323–325, 329
See application file for complete search history.

(56) References Cited

U.S. PATENT DOCUMENTS 4,167,476 A * 9/1979 Jackson ..... 209/3.3
4,247,008 A * 1/1981 Dobbs ..... 209/569
6,566,620 B1 5/2003 Lohmann
6,762,384 B1 * 7/2004 Kechel ..... 209/584
2003/0155282 A1 * 8/2003 Kechel ..... 209/584
2004/0030661 A1 * 2/2004 Amato ..... 705/406
2004/0153208 A1 * 8/2004 Wilke ..... 700/224

(Continued)

FOREIGN PATENT DOCUMENTS

AU 2006202645 B2 1/2007

(Continued)

OTHER PUBLICATIONS

French Search Report dated Dec. 2, 2009 for FR0953252.

(Continued)

*Primary Examiner* — Gene Crawford
*Assistant Examiner* — Kyle Logan
(74) *Attorney, Agent, or Firm* — Sughrue Mion, PLLC

(57) ABSTRACT

In a method of sorting mailpieces in a plurality of sorting passes in a postal sorting machine (10) provided with sorting outlets so as to sequence the mailpieces in the sorting outlets for delivery in the order of a delivery round, delivery points defining the delivery round are grouped together into disjoint subsets of delivery points. For the various sorting passes, the delivery points of each subset are associated every time with a common sorting outlet. Statistical data (11) is retrieved from a memory of the machine, which data is associated with respective ones of said delivery points, and is representative of the volume of mail delivered in association with the delivery point in question, and successive delivery points are grouped together into a common subset of delivery points by taking account of said statistical data associated with said delivery points.

5 Claims, 2 Drawing Sheets

U.S. PATENT DOCUMENTS

Figure 3:
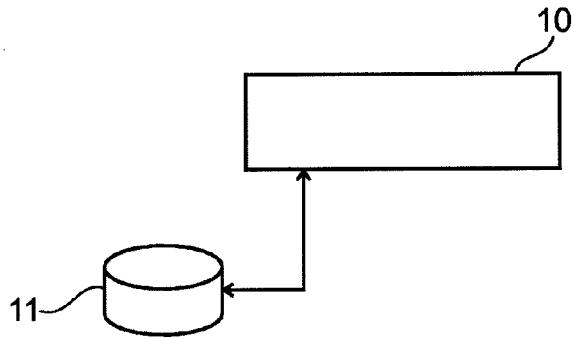

| | | | | |
|---|---|---|---|---|
| 2004/0182759 | A1 | 9/2004 | Jirsa | |
| 2004/0200761 | A1* | 10/2004 | Hanson et al. | 209/584 |
| 2005/0279674 | A1* | 12/2005 | Gillet | 209/584 |
| 2008/0000817 | A1* | 1/2008 | Kostyniuk et al. | 209/584 |
| 2008/0041770 | A1* | 2/2008 | Mileaf et al. | 209/584 |

FOREIGN PATENT DOCUMENTS

| | | | |
|---|---|---|---|
| EP | 1736250 | A2 | 12/2006 |
| EP | 2011578 | A1 | 1/2009 |
| WO | 9907487 | | 2/1999 |
| WO | 03024628 | A1 | 3/2003 |

OTHER PUBLICATIONS

International Search Report for PCT/FR2010/050853 Sep. 22, 2010.

* cited by examiner

Prior art sorting plan

Pass 1:

P1

| S1 | S2 | S3 | S4 |
|---|---|---|---|
| 1 | 2 | 3 | 4 |
| 5 | 6 | 7 | 8 |
| 9 | 10 | 11 | 12 |
| 13 | 14 | 15 | 16 |

Pass 2:

P2

| S1 | S2 | S3 | S4 |
|---|---|---|---|
| 1 | 5 | 9 | 13 |
| 2 | 6 | 10 | 14 |
| 3 | 7 | 11 | 15 |
| 4 | 8 | 12 | 16 |

Fig. 1

Sorting plan of the invention

Pass 1:

10 10 P11

| S1 | S2 | S3 | S4 |
|---|---|---|---|
| [1,2] | [3,4] | [5,6] | [7,8] |
| [9,10] | [11,12] | [13,14] | [15,16] |
| [17,18] | [19,20] | [21,22] | [23,24] |
| [25,26] | [27,28] | [29,30] | [31,32] |

Pass 2:

P12

| S1 | S2 | S3 | S4 |
|---|---|---|---|
| [1,2] | [9,10] | [17,18] | [25,26] |
| [3,4] | [11,12] | [19,20] | [27,28] |
| [5,6] | [13,14] | [21,22] | [29,30] |
| [7,8] | [15,16] | [23,24] | [31,32] |

Sorting of the invention

Unstacking order: 31, 25, 25, 4, 3,10,14,18, 29,10,15, 9,16, 6, 9, 22, 19

Pass 1:

R11

| S1 | S2 | S3 | S4 |
|---|---|---|---|
| 9 | | | |
| 9 | | | |
| 10 | | | |
| 18 | | 22 | |
| 10 | 19 | 6 | 16 |
| 25 | 3 | 29 | 15 |
| 25 | 4 | 14 | 31 |

Re-circulating order:
31, 15, 16, 14, 29, 6, 22, 4, 3,
19, 25, 25, 10, 18, 10, 9, 9

Pass 2:

R12

| S1 | S2 | S3 | S4 |
|---|---|---|---|
| | 9 | | |
| | 9 | | |
| | 10 | | |
| | 10 | | 25 |
| 3 | 14 | 18 | 25 |
| 4 | 16 | 19 | 29 |
| 6 | 15 | 22 | 31 |

Fig. 2

12

| | | | | | | | | | | |
|---|---|---|---|---|---|---|---|---|---|---|
| Mondays | ODP: | 11 | 13 | 15 | 17 | 19 | 21 | 23 | 25 | ... |
| | Weight: | 0.2 | 0.3 | 0.1 | 0.7 | 5.2 | 4.2 | 0.3 | 0.4 | ... |
| Tuesdays | ODP: | 11 | 13 | 15 | 17 | 19 | 21 | 23 | 25 | ... |
| | Weight: | 0.5 | 0.3 | 0.2 | 0.8 | 6.3 | 5.2 | 0.4 | 0.4 | ... |
| Wednesdays | ODP: | 11 | 13 | 15 | 17 | 19 | 21 | 23 | 25 | ... |
| | Weight: | 0.0 | 0.3 | 0.2 | 0.2 | 4.3 | 3.5 | 0.2 | 0.4 | ... |

13

| | | | | | | | | | | |
|---|---|---|---|---|---|---|---|---|---|---|
| Mondays | Group | G1 | | | G2 | G3 | G4 | G5 | | |
| | ODP: | 11 | 13 | 15 | 17 | 19 | 21 | 23 | 25 | ... |
| | Weight: | 0.2 | 0.3 | 0.1 | 0.7 | 5.2 | 4.2 | 0.3 | 0.4 | ... |
| Tuesdays | Group | G1 | | G2 | G3 | G4 | G5 | G6 | | |
| | ODP: | 11 | 13 | 15 | 17 | 19 | 21 | 23 | 25 | ... |
| | Weight: | 0.5 | 0.3 | 0.2 | 0.8 | 6.3 | 5.2 | 0.4 | 0.4 | ... |
| Wednesdays | Group | G1 | | | | G2 | G3 | G4 | | |
| | ODP: | 11 | 13 | 15 | 17 | 19 | 21 | 23 | 25 | ... |
| | Weight: | 0.0 | 0.3 | 0.2 | 0.2 | 4.3 | 3.5 | 0.2 | 0.4 | ... |

METHOD OF SORTING MAILPIECES IN A LOW-CAPACITY MACHINE

The invention relates to a method of sorting mailpieces in a plurality of sorting passes in a postal sorting machine provided with sorting outlets so as to sequence the mailpieces in the sorting outlets for delivery in the order of a delivery round or "postman's walk", in which method delivery points defining the delivery round are grouped together into disjoint subsets of delivery points, and in which method, for the various sorting passes, the delivery points of each subset are associated every time with a common sorting outlet.

Such a method that is known from Patent Document EP-2 011 578 serves to increase fictitiously the sorting capacities of a postal sorting machine.

In general, the number of delivery points that a postal sorting machine is capable of processing for sequencing the mailpieces in the order of a delivery round is determined by the following relationship: $C=S^P$, where C represents the sorting capacity in terms of delivery points, S represents the number of available sorting outlets of the machine, and P designates the number of sorting passes.

By grouping the delivery points together in groups of delivery points in a delivery round, the sorting is performed in the order of the delivery round by considering each of the groups of delivery points as a respective single "fictitious" delivery point. In this way, the sorting capacity of a machine is increased without increasing the number of sorting outlets originally designed for the machine.

In that known method, substantially the same number of delivery points are grouped together in each subset of delivery points and, in addition, provision is made so that, in the final sorting pass, the mailpieces directed to the same sorting outlet are re-sequenced so as to remedy the disordered sequencing caused by the delivery points being grouped together. That final processing requires a sophisticated and therefore costly mechanism to be incorporated upstream from the sorting outlets of the machine.

An object of the invention is to propose a method as defined above, in which no specific processing is performed in the final sorting pass to re-sequence the mailpieces, but rather, at the end of the final sorting pass, the mailpieces in each sorting outlet of the machine are left disordered to some extent due to the delivery points being grouped together. However, another object of the invention is to propose a mailpiece-sorting method with which the disordered sequencing caused by the delivery points being grouped together is the least awkward possible for the delivery person so as to enable the mail to be delivered correctly.

The basic idea of the invention is to group the delivery points of the delivery round together in non-uniform manner by taking account of the volume of mail that is delivered to each delivery point of the delivery round. More particularly, the basic idea of the invention is, for example, to observe over time the volume of mail delivered for each delivery point of the delivery round so as to determine a characteristic level of activity for each delivery point. The observation may be performed cyclically and it is possible to make provision to consolidate a plurality of cyclic observations so as to determine a characteristic mean level of activity for each delivery point.

The invention therefore provides a method of sorting mailpieces in a plurality of sorting passes in a postal sorting machine provided with sorting outlets so as to sequence the mailpieces in the sorting outlets for delivery in the order of a delivery round, in which method delivery points defining the delivery round are grouped together into disjoint subsets of delivery points, and in which method, for the various sorting passes, the delivery points of each subset are associated every time with a common sorting outlet, said method being characterized in that statistical data is retrieved from a memory of the machine, which data is associated with respective ones of said delivery points, and is representative of the volume of mail delivered in association with the delivery point in question, and in that successive delivery points are grouped together into a common subset of delivery points by taking account of said statistical data associated with said delivery points.

The invention extends to a postal sorting machine that has sorting outlets and that is suitable for sequencing mailpieces in the sorting outlets for delivery in the order of a delivery round, the machine being arranged in a manner such that delivery points defining the delivery round are grouped together into disjoint subsets of delivery points, and in a manner such that, for successive sorting passes, the delivery points of each subset are associated every time with a common sorting outlet, said machine being characterized in that it is further arranged in a manner such that statistical data is retrieved from a memory, which data is associated with respective ones of said delivery points, and is representative of the volume of mail delivered in association with the delivery point in question, and in a manner such that successive delivery points are grouped together into a common subset of delivery points by taking account of said statistical data associated with said delivery points.

In a first feature of the method or of the machine of the invention, the statistical data also indicates whether or not the delivery point in question can be grouped with another delivery point in the delivery round. In a second feature of the method or of the machine of the invention, the statistical data associated with two consecutive delivery points in a delivery round is compared with a predetermined threshold so as to group these two delivery points together in the same subset.

Figure 4:
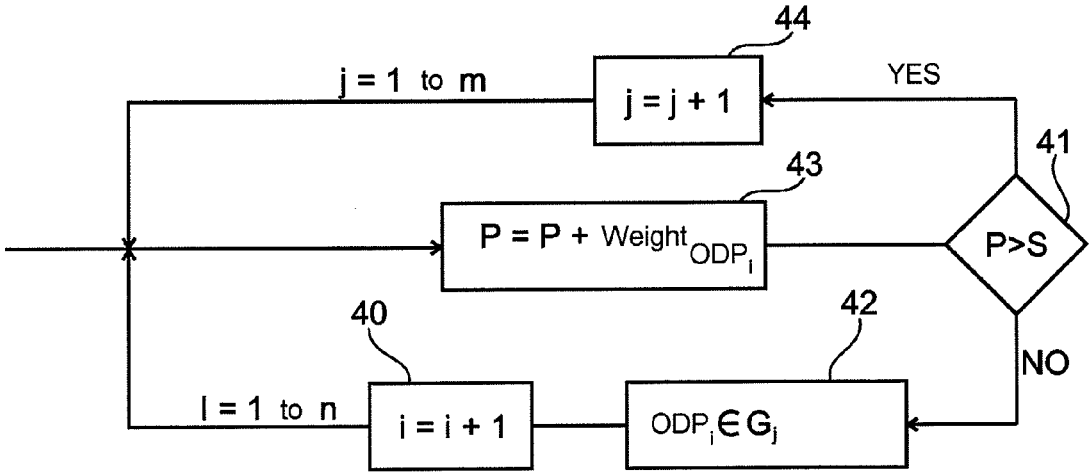

The invention can be understood more clearly on reading the following description with reference to the drawings. This description is given merely by way of indicative example and is in no way limiting on the invention. In the drawings:

- FIG. 1 shows a method of sorting mailpieces without the delivery points being grouped together;
- FIG. 2 shows a method of the invention in which the delivery points are grouped together for the purpose of fictitiously increasing the sorting capacities of a postal sorting machine;
- FIG. 3 shows how statistical data representing a certain amount of activity associated with each delivery point is taken into account for implementing the method of the invention; and
- FIG. 4 is a highly simplified flow chart of the method of the invention.

FIG. 1 shows the assignment configurations in which 16 delivery points (indicated by the numerical values 1, 2, 3, . . . , 16) are assigned to four sorting outlets S1 to S4 in two sorting plans P1 and P2 for sorting in two passes. The sorting plan P1 determines how the sorting outlets are assigned to the delivery points for performing the first sorting pass. The sorting plan P2 determines how the sorting outlets are assigned to the delivery points for performing the second sorting pass. In the sorting plan P1, the delivery points 1, 2, 3, and 4 are assigned to respective ones of the outlets S1, S2, S3, and S4. The delivery points 5 to 8, 9 to 12, and 13 to 16 are assigned in the same way to respective ones of the outlets S1 to S4. Thus, the delivery points 1, 5, 9, and 13 are assigned to the outlet S1. The delivery points 2, 6, 10, and 14 are assigned to the outlet S2. The delivery points 3, 7, 11, and 15are assigned to the outlet S3. The delivery points 4, 8, 12, and 16 are assigned to the outlet S4. Therefore, two consecutive delivery points in the delivery round are not assigned to the same sorting outlet in this example. On the contrary, in the sorting plan for the first pass, two consecutive delivery points are always assigned to different sorting outlets so as to obtain an ordered sequence of mailpieces during the second sorting pass using the sorting plan P2.

In the sorting plan P2, the delivery points 1 to 4are assigned to the sorting outlet S1. Similarly, the delivery points 5 to 8 are assigned to the outlet S2. The delivery points 9 to 12 are assigned to the outlet S3. The delivery points 13 to 16 are assigned to the outlet S4. The concatenation of the sorting outlets S1-S2-S3-S4 at the end of the second sorting pass thus forms an ordered sequence of delivery points for delivery of the mail.

The sorting method of the invention is described below with reference to FIG. 2, also using four sorting outlets S1-S4, but with which outlets 32 delivery points are sorted in 2 passes. The sorting plan of the first sorting pass is referenced P11 in FIG. 2, while the second sorting plan for the second sorting pass is referenced P12. In the example shown in FIG. 2, the delivery points are grouped together into disjoint subsets 10 having a number N of delivery points, which number is N=2 in this example.

In the sorting plan P11, the consecutive delivery points 1 and 2 of the delivery round are grouped together to form a first subset [1,2] that is assigned to the outlet S1. Similarly, the consecutive delivery points 3and 4 are grouped together to form a second subset [3,4] that is assigned to the outlet S2, etc. Therefore, the subsets [1,2], [9,10], [17,18], and [25,26] are assigned to the outlet S1. The subsets [3,4], [11,12], [19,20], and [27,28] are assigned to the outlet S2. The subsets [5,6], [13,14], [21,22], and [29,30] are assigned to the outlet S3. The subsets [7,8], [15,16], [23,24], and [31,32] are assigned to the outlet S4. The sorting plan P11 thus associates subsets of two delivery points with the sorting outlets.

In the sorting plan P12, the subsets [1,2], [3,4], [5,6], and [7,8] are assigned to the sorting outlet S1. Similarly, the groups of subsets [9,10]-[11,12]-[13,14]-[15-16], [17,18], [19-20]-[21,22]-[23,24], and [25,26]-[27,28]-[29,30]-[31, 32] are assigned to respective ones of the sorting outlets S2, S3, and S4.

Thus, for the two sorting plans P11 and P12, the sorting outlets of the machine are associated with subsets of pairs of delivery points so that the delivery points of each subset are associated every time with a common sorting outlet.

This grouping together into subsets results not only in an increase in the sorting capacity but also in a sorting uncertainty within each subset. For example, two mailpieces both having delivery points belonging to the same subset can find themselves sorted in the wrong order after the second sorting pass as illustrated below with reference to FIG. 2.

During the first sorting pass, the sorting machine is initialized so as to execute the sorting plan P11. The mailpieces are unstacked in a certain order and each mailpiece is directed towards the sorting outlet that corresponds to the delivery point recognized for said mailpiece. In the example, 17 mailpieces are sorted, which mailpieces have the following respective delivery points in the unstacking order: 31, 25, 25, 4, 3, 10, 14, 18, 29, 10, 15, 9, 16, 6, 9, 22, and 19. The first mailpiece is unstacked, its delivery point 31 is read and, in application of the sorting plan P11, said first mailpiece is directed towards the sorting outlet S4. The following mailpieces are sorted in sequence in the same way. Thus, the second mailpiece having the delivery point 25 is directed towards the sorting outlet S1. The result of the sorting in the first pass in the sorting plan P11 is given by the table R11.

The mailpieces are then re-circulated in conventional manner to the inlet of the sorting machine in the order of the sorting outlets S4 to S1 for a second sorting pass using the sorting plan P12. The order of the delivery points corresponding to the re-circulated mailpieces is thus as follows: 31, 15, 16, 14, 29, 6, 22, 4, 3, 19, 25, 25, 10, 18, 10, 9, and 9. During the second sorting pass, the mailpiece having the delivery point 31 is directed towards the sorting outlet S4, and so on for the other mailpieces.

The result of the sorting in the second pass is shown by the table R12. In the sorting outlet S1, the mailpieces are sorted in the right order but in the outlet S2 it can be seen that the mailpieces having the delivery points 16 and 15 find themselves paced in the reverse order relative to the order of delivery of the mail. This is the uncertainty that comes with implementing the method of the invention.

However, in practice, in a delivery round, there can be a large number of delivery points for which the volume of mail to be delivered is very small. In other words, people do not necessarily receive mail every day. The method of the invention makes use of this situation to limit this uncertainty as much as possible.

In the invention, provision may be made for the delivery point reversals to be indicated either on the sorting outlet of the machine, or on the label of the storage tray or bin at the sorting outlet that contains the reversed mailpieces, or indeed on a list that is given to the delivery person delivering the mail. For this purpose, the sorting machine is arranged to detect any relative disordered sequencing of the mailpieces directed towards a sorting outlet, and then to indicate the disordered sequencing detected in the form of a printout. The detection can be performed easily by a machine program that, for the successive mailpieces arriving in each sorting outlet, monitors the progression of the delivery points identified for said mailpieces in the ordered list of delivery points that corresponds to the delivery round. In our example, the delivery person picks up the mailpieces for the delivery round with an accompanying list indicating that the delivery points 15and 16 are reversed. The delivery person can then correct this error by reversing the mailpieces having the delivery points 15 and 16 at the time the delivery person picks up the round, or indeed can take the error into account while doing the delivery.

In the method of the invention, the grouping together of the delivery points of a delivery round is therefore not performed uniformly as shown in FIG. 2, but rather it is performed dynamically as a function of statistical data (that can be updated regularly) that is representative of certain levels of activity of the delivery points of the round.

In the invention, a first campaign of readings is conducted on the sorting machine (the machine of the inward sorting center on which the delivery rounds are prepared), which first campaign consists in taking readings over a given period of time of the volume of mail delivered in association with each delivery point of a delivery round. These readings are taken for all of the delivery rounds prepared on the machine. During this campaign, the sorting machine 10 shown in FIG. 3 is used for preparing delivery rounds conventionally (i.e. without grouping together and as in FIG. 1).

At the end of this first campaign of readings (campaign for initializing the process), statistics 11 are obtained for each delivery round, which statistics are indicative of the volume of mail delivered in association with each delivery point of the round, in a manner differentiated depending on the days of the week, for example. It is known that the activity of a delivery point can vary from one day to another, and that that variation can repeat itself in the same way from one week to another.

The machine 11 can thus be programmed so that said statistical data 11 is data that is consolidated automatically (and thus updated) over time, including while the sorting machine of the method of the invention is being used. The consolidation may, for example, take place in a weekly cycle so that the statistical data represents mean values for volume of mail associated with each delivery point of a delivery round.

In FIG. 3, the table 12 shows statistical data obtained after a campaign conducted over several weeks, for example. The statistical data is indicated on the line bearing the reference "weight" while the corresponding delivery points are indicated on the line bearing the reference "ODP". It can be observed that for the delivery point 11, the weight is 0.2 for Mondays, 0.5 for Tuesdays, and 0.0 for Wednesdays. It is thus observed that the volume of mail associated with this delivery point varies depending on the days of the week, and this varying volume is used advantageously by the invention in grouping together the delivery points.

Naturally, the readings could be differentiated over all of the days in one month and used with a monthly consolidation cycle, for example. What is essential is for the statistical data to reflect as well as possible the reality of the activity of each delivery point at the time at which the grouping of that delivery point is to be performed and used by the sorting machine 10.

The table 13 in FIG. 3 shows a plurality of groups of delivery points that are grouped together using the statistical data of table 12 for the different days of the week.

With reference to the highly simplified flow chart of FIG. 4, for grouping together the delivery points of a delivery round, the machine 10 sequentially scans at 40 the ordered list of delivery points $ODP_i$ (where i lies in the range 1 to n) of a delivery round starting with the first delivery point in the list so as to construct a first group such as $G_j$ (where j lies in the range 1 to m). The statistical data ($Weight_{ODPi}$) associated with said delivery point for the day of the week in question is retrieved from the database 11 and is compared with a threshold value S at 41 that is an input parameter for the grouping-together process. In the example of FIG. 3, the threshold is set at 1 and the weight of the delivery point 11 is 0.2 on Mondays. Grouping together at 42 into a current group $G_j$ continues so long as the cumulative total P at 43 of the weights associated with the successive delivery points added to the group does not exceed the threshold S. If the threshold is exceeded at 41, then the process continues on a new group of delivery points (block 44 in FIG. 4). And so on for each delivery round recorded in the machine 10.

In table 13, it can be observed that the groups of delivery points G1, G2, G3, G4 and G5 differ from one day of the week to another. For example, on Mondays, the group G1 comprises three consecutive delivery points, on Tuesdays it comprises two consecutive delivery points, and on Wednesdays it comprises four consecutive delivery points. From the table 13, it can been seen that, overall, for the same delivery round, the machine 10 sorts into five groups of delivery points on Mondays, into six groups on Tuesdays, and into four groups on Wednesdays. These variations enable the operator to sort various numbers of delivery rounds at the same time on the machine by using all of the sorting outlets.

It is also possible to make provision, when grouping the delivery points together, to take account of additional information associated with each delivery point and that is indicative of whether or not the delivery point can be grouped with another delivery point. This offers the advantage of preventing, for example, grouping together of two consecutive delivery points that are of low activity and that are geographically distant from each other.

The invention claimed is:

1. A method of sorting mailpieces in a plurality of sorting passes in a postal sorting machine provided with sorting outlets wherein delivery points recognized for said mailpieces are assigned to said sorting outlets so as to sequence the mailpieces in the sorting outlets for delivery in an order of a delivery round, said method comprising the steps of:

retrieving from a database, statistical data representative of mail volumes delivered respectively for said delivery points, constructing into said machine disjoint subsets with said delivery points, each subset comprising successive delivery points grouped together in such a way that a cumulative weight of statistical data associated to the delivery points of said subset is less than a predefined threshold, and assigning said subsets of delivery points to said sorting outlets so that the delivery points of each subset are associated every time with a common sorting outlet for sequencing said mailpieces in the sorting outlets.

2. A method according to claim 1, wherein said statistical data also indicate whether or not a delivery point can be grouped with another delivery point in a subset of delivery points.

3. A method according to claim 1, wherein said statistical data representative of volume of mail are stored in the database in a manner differentiated depending of the days in a week.

4. A method according to claim 1, wherein said statistical data representative of volume of mail are stored in the database in a manner differentiated depending of the days in a month.

5. A postal sorting machine that has sorting outlets and that is suitable for sequencing mailpieces in the sorting outlets for delivery in the order of a delivery round, said machine comprising:

means for retrieving from a database, statistical data representative of mail volumes delivered respectively for said delivery points, means for constructing disjoint subsets with said delivery points, each subset comprising successive delivery points grouped together in such a way that a cumulative weight of statistical data associated to the delivery points of said subset is less than a predefined threshold, and means for assigning said subsets of delivery points to said sorting outlets so that the delivery points of each subset are associated every time with a common sorting outlet for sequencing said mailpieces in the sorting outlets.

* * * * *